US006120645A

United States Patent [19]

Loser et al.

[11] Patent Number: 6,120,645

[45] Date of Patent: Sep. 19, 2000

[54] PROCESS FOR OPERATING A PRESS SECTION FOR FORMING A WEB

[75] Inventors: Hans Loser, Langenau; Joachim Henssler, Ravensburg; Karl Steiner, Herbrechtingen, all of Germany

[73] Assignee: Voith Sulzer Papiermaschinen GmbH, Heidenheim, Germany

[21] Appl. No.: 08/994,368

[22] Filed: Dec. 19, 1997

[30] Foreign Application Priority Data

Dec. 20, 1996 [DE] Germany ..... 196 53 505

[51] Int. Cl.[7] ..... D21F 3/06

[52] U.S. Cl. ..... 162/198; 162/205; 162/DIG. 6

[58] Field of Search ..... 162/198, 205, 162/DIG. 6, 362, 363, DIG. 11

[56] References Cited

U.S. PATENT DOCUMENTS

| | | | |
|---|---|---|---|
| 4,576,682 | 3/1986 | Laapotti . | |
| 4,889,048 | 12/1989 | Miller . | |
| 4,973,384 | 11/1990 | Crouse et al. . | |
| 5,047,122 | 9/1991 | Crouse et al. . | |
| 5,167,768 | 12/1992 | Cronin et al. | 162/205 |

FOREIGN PATENT DOCUMENTS

| | | |
|---|---|---|
| 3410172 | 9/1984 | Germany . |
| 89/09690 | 10/1989 | WIPO . |
| 91/00389 | 1/1991 | WIPO . |

*Primary Examiner*—Peter Chin
*Attorney, Agent, or Firm*—Greenblum & Bernstein, P.L.C.

[57] ABSTRACT

A process for operating a press section for producing a fibrous material web, with a nip that is elongated in the direction of web travel that includes an inlet zone, a main pressing zone, and an outlet zone, and where a pressure gradient of pressure p exerted in the main pressing zone of the nip is selected as a function of whether the fibrous material web entering in the nip has an average or high dry matter content, on the one hand, or a low dry matter content, on the other hand.

23 Claims, 2 Drawing Sheets

PROCESS FOR OPERATING A PRESS SECTION FOR FORMING A WEB

CROSS-REFERENCE TO RELATED APPLICATION

The present invention claims the priority under 35 U.S.C. §119 of German Application No. 196 53 505.0 filed Dec. 20, 1996, the disclosure of which is expressly incorporated by reference herein in its entirety.

BACKGROUND INFORMATION

1. Field of the Invention

The invention relates to a press section of a machine for producing a fibrous material web, such as a paper and/or cardboard web, with at least one nip that is elongated in the direction of web travel and includes an inlet zone, a main pressing zone, and an outlet zone, where the fibrous material web is guided through the nip.

2. Discussion of Background Information

In press sections of this type, particularly where the fibrous material web to be treated has an average to high incoming dry matter content, compaction of the web surface due to excessive pressures frequently occurs. Steep pressure increases are particularly damaging in this regard. This results, among other things, in a lower pressure output in the drier section, and in a relatively low bond strength. Furthermore, this reduces the effectiveness of subsequent press processes.

When the fibrous web to be processed has a low dry matter content, it also has low strength. Moreover, with an excessive pressure increase in the direction of web travel, undesirable compression of the web in the nip may result. A danger of this kind of compression exists particularly for fibrous web material having a surface weight measured in $g/m^2$ in the high range.

SUMMARY OF THE INVENTION

To avoid these problems, the preset invention provides a press section with optimal de-watering capacity and which at the same time produces a fibrous web of as high a quality as possible.

The present invention is premised on the fact that the pressure gradient dp/dl of the pressure p produced in the main zone of a nip extending a length l in a direction of web travel (where the pressure gradient occurs in the direction of web travel and therefore in the direction of the nip length l), is selected as a function of whether the fibrous material web entering the nip has an average to high dry matter content or a low dry matter content. The calculation for selecting the pressure gradient is performed once per type of web material.

For an incoming fibrous web having average to high dry matter content, the pressure gradient dp/dl lies in the range of approximately $0.01 \cdot p_{max}/cm$ to approximately $0.08 \cdot p_{max}/cm$, and preferably has a value of approximately $0.04 \cdot p_{max}/cm$, where $p_{max}$ is a predeterminable maximum pressure at an end section of the main pressing zone. Predeterminable maximum pressure $p_{max}$ may have a value within the range of approximately 20 bar to 100 bar, where a value for $p_{max}$ of approximately 380 bar may be typical.

For an incoming web having low dry matter content, the maximum pressure gradient $(dp/dl)_{max}$ of pressure p to be produced in the inlet one and/or the main pressing zone (where the pressure gradient occurs in the direction of travel) is preferably selected so that it satisfies the relation:

$$\left(\frac{dp}{dl}\right)_{\max} \leq 2\frac{bar}{\text{cm}} \cdot \left(\frac{p}{bar}\right)^{1.27} \cdot \left(\frac{50\,\text{g/m}^2}{FG}\right)$$

where p is the pressure of the main pressing zone, and FG is surface weight (in $g/m^2$) of the incoming fibrous material web. Pressure p to be produced in the main zone may have a value of approximately 5 bar to 30 bar.

Particularly with the incoming fibrous web having low dry matter content, the maximum pressure gradient is advantageously selected as a function of the surface weight of the incoming fibrous material web. As a result, the maximum permissible pressure gradient is a function of both the dry matter content of the incoming fibrous material web, and the surface weight of the web. The dry matter content of the fibrous web is considered low when it is approximately 8% to 25%.

According to the present invention, it is therefore possible to cover de-watering regions of the web in the press section that were previously reserved for the screen section.

At an average to high dry matter content of the incoming fibrous web, the pressure gradient dp/dl of the pressure p to be produced in the inlet zone of the nip is selected so that it satisfies the relation:

$$\frac{dp}{dl} \approx \left(\frac{100\,\text{g/m}^2}{FG}\right) \cdot \sqrt[4]{\frac{p_1}{bar}} \cdot \frac{p_1}{\text{cm}}$$

where $p_1$ is the predeterminable pressure at the beginning of the main pressing zone, or the predeterminable pressure at the end of the inlet zone, and FG is the surface weight (in $g/m^2$) of the incoming fibrous web. Pressure p to be produced in the inlet zone may have a value within the range of approximately 0.1 bar to 5 bar. Further, predeterminable pressure $p_1$ at the end of the inlet zone may have a value within the range of approximately 1 bar to 5 bar, and predeterminable pressure $p_1$ at the beginning of the main pressing zone may have a value of approximately 10 bar.

It is preferred, with the incoming fibrous web having average to high dry matter content, that the pressure gradient dp/dl of the falling pressure p to be produced in the outlet zone of the (where the pressure gradient is produced in the direction of web travel) be selected so that it satisfies the relation:

$$\left|\frac{dp}{dl}\right| < \left(\frac{100\,\text{g/m}^2}{FG}\right) \cdot \sqrt[4]{\frac{p_{\max}}{bar}} \cdot \frac{p_{\max}}{\text{cm}}$$

where $p_{max}$ is the predeterminable maximum pressure at the end of the main pressing zone, and FG is the surface weight (in $g/m^2$) of the incoming fibrous web. Decreasing pressure p to be produced in the outlet zone may have a value within the range of about 80 bar to 0 bar.

According to another embodiment of the invention, the predeterminable pressure $p_1$ at the beginning of the main pressing zone is selected so that it satisfies the relation:

$$\frac{p_1}{(bar)} \approx \left(\frac{T}{\%}\right)^{3.5\text{ to }4}$$

where T is the dry matter content of the incoming fibrous web. Together with a pressure gradient selected in the manner described above, a pressure $p_1$ that satisfies this relation leads on the whole to an optimal pressure profile. It takes into account that with a corresponding pressure gradient, the dry matter content of the fibrous material web along the length of the nip will increase due to de-watering, and that the chronological increase in pressure is determined by means of the pressure gradient. In particular, the desired increase in press pressure can be predetermined based on a corresponding shoe parameter (e.g., its length, shape, etc.).

The elongated (or extended) nip is preferably positioned between a rotating, flexible press belt, which is guided via at least one press shoe, and a counter roll. In particular, the elongated nip can be embodied as a shoe press.

The counter roll is preferably provided with holes, grooves, and/or suction. Consequently, a suitable lubricant an flow out of the perforated and/or grooved counter roll, and/or it can be suctioned out of the roll with a suction device.

Particularly at low levels of force in the longitudinal nip press, for example in the region of 10 kN/m, and where the lubricant film thickness is relatively high, the region between the press shoe and the flexible press belt can be lubricated with water. As a result, it is possible according to the present invention to use the press shoe in a continuous loop that is one at its end faces, and to correspondingly use an open system in which the shoe length is relatively large, for example, markedly larger than 350 mm.

According to another embodiment of the present invention, it is preferred to use a continuous loop formed by the rotating, flexible press belt at its two open end faces.

The present invention provides a process for operating a press section for producing a fibrous web, including forming a nip that is elongated in a web travel direction, the nip including an inlet zone having an inlet beginning and an inlet end, a main pressing zone having a main beginning and a main end, and an outlet zone; determining a pressure to be applied in the main pressing zone; selecting a pressure gradient in the main pressing zone as a function of a dry matter content of the fibrous web entering the elongated nip, wherein the pressure gradient is related to the selected pressure to be applied in the main pressing zone, guiding the fibrous web in a web travel direction through the elongated nip; and forming the selected pressure gradient.

According to another aspect of the invention, the selecting of the pressure gradient, where the dry matter content of the web entering the nip is in an average condition or a high condition, by determining a maximum pressure to be applied at the main end of the nip and selecting the pressure gradient from a range of approximately $0.04 \cdot p_{max}$/cm. A dry mater content of the web as it enters the elongated nip of approximately 20% to approximately 40% constitutes an average condition, and a dry mater content of approximately 30% to approximately 60% constitutes a high condition.

Another aspect of the invention involves selecting an inlet pressure gradient to be produced in the inlet zone according to the relation $$\frac{dp}{dl} \approx \left(\frac{100\,\mathrm{g/m^2}}{FG}\right) \cdot \sqrt[4]{\frac{p_1}{bar}} \cdot \frac{p_1}{\mathrm{cm}}$$

where $p_1$ is a pressure to be exerted at tone of the main beginning and the inlet end, and where FG is a surface weight (in g/m$^2$) of the web entering the tip.

Yet another aspect of the invention entails selecting an outlet pressure gradient to be produced in the outlet zone according to the relation $$\left|\frac{dp}{dl}\right| < \left(\frac{100\,\mathrm{g/m^2}}{FG}\right) \cdot \sqrt[4]{\frac{p_{\max}}{bar}} \cdot \frac{p_{\max}}{\mathrm{cm}}$$

where $p_{max}$ is a maximum pressure to be applied at the main end, and where FG is a surface weight (in g/m$^2$) of the web entering the nip.

Still another aspect of the invention involves determining a main beginning pressure ($p_1$) in accordance with the relation $$\frac{p_1}{(bar)} \approx \left(\frac{T}{\%}\right)^{3.5\text{ to }4}$$

where T is the dry matter content of the web entering the nip. Further, the forming of the nip may include positioning a rotating, flexible press belt, which is guided via a press shoe, against a counter roll. This may also involve suctioning the counter roll, and the counter roll also may have holes and/or grooves. Further, the present invention may involve lubricating a region between the press section and the flexible press belt with water. Moreover, the rotating, flexible belt comprises two ends faces, and wherein the belt is open at the end faces.

According to another aspect of the invention, the selecting of the pressure gradient, when the dry content of the web entering the nip is in a low condition, by selecting a maximum main zone pressure gradient according to the relation $$\left(\frac{dp}{dl}\right)_{\max} \le 2\frac{bar}{\mathrm{cm}} \cdot \left(\frac{p}{bar}\right)^{1.27} \cdot \left(\frac{50\,\mathrm{g/m^2}}{FG}\right)$$

where FG is a surface weight (in g/m$^2$) of the web entering the nip. Moreover, the forming of the nip may comprise guiding a rotating, flexible press belt via a press show against a counter roll. This may also involve suctioning the counter roll, and the counter roll may have holes and/or grooves. Further, the present invention may involve lubricating a region between the press section and the flexible press belt with water. Moreover, the rotating, flexible belt comprises two ends faces, and wherein the belt is open at the end faces. A dry mater content of the web as it enters the elongated nip of approximately 8% to approximately 25% constitutes the low condition.

According to another aspect of the invention, the selecting of the pressure gradient, when the dry content of the web entering the nip is in a low condition, by selecting a maximum inlet zone pressure gradient according to the relation $$\left(\frac{dp}{dl}\right)_{\max} \le 2\frac{bar}{\mathrm{cm}} \cdot \left(\frac{p}{bar}\right)^{1.27} \cdot \left(\frac{50\,\mathrm{g/m^2}}{FG}\right)$$

where FG is a surface weight (in g/m$^2$) of the web entering the nip. Moreover, the forming of the nip may comprise guiding a rotating, flexible press belt via a press shoe against a counter roll. This may also involve suctioning the counter roll, and the counter roll may have holes and/or grooves. Further, the present invention may involve lubricating a region between the press section and the flexible press belt with water. Moreover, the rotating, flexible belt comprises two ends faces, and wherein the belt is open at the end faces. A dry mater content of the web as it enters the elongated nip of approximately 8% to approximately 25% constitutes the low condition.

The present invention also provides a press section of a machine for producing a fibrous material web, which includes: a nip that is elongated in a web travel direction that includes an inlet zone having an inlet beginning and an inlet end, a main pressing zone having a main beginning an a main end, and an outlet zone, where a pressure p is applied in the main pressing zone, where a pressure gradient in the main pressing zone is selected as a function of a dry matter content of the fibrous material web entering the elongated nip, where the pressure gradient is related to the pressure p applied in the main pressing zone, and where the fibrous web is guided in a web travel direction through the elongated nip to form the pressure gradient. Further, where the dry content of the web entering the nip is determined to be average or high, the maximum pressure to be applied at the main end of the nip is determined such that the pressure gradient has a value within a range of approximately $0.01 \cdot p_{max}$/cm to approximately $0.08 \cdot p_{max}$/cm, where $p_{max}$ represents the determined maximum pressure to be applied. It is preferred if the selected pressure gradient has a value of approximately $0.04 \cdot p_{max}$/cm.

According to another aspect of the invention, for an incoming web having average to high dry matter content, the inlet pressure gradient of this press section is selected for pressure produced in the inlet zone according to the relation $$\frac{dp}{dl} \approx \left(\frac{100\,\mathrm{g/m^2}}{FG}\right) \cdot \sqrt[4]{\frac{p_1}{bar}} \cdot \frac{p_1}{\mathrm{cm}}$$

where $p_1$ is a pressure exerted at one of the main beginning and inlet end, and where FG is the surface weight (in g/m$^2$) of the web entering the nip. Further, for an incoming web having an average to high dry matter content, an outlet pressure gradient is selected for pressure produced in the outlet zone according to the relation $$\left|\frac{dp}{dl}\right| < \left(\frac{100\,\mathrm{g/m^2}}{FG}\right) \cdot \sqrt[4]{\frac{p_{\max}}{bar}} \cdot \frac{p_{\max}}{\mathrm{cm}}$$

where $p_{max}$ is a maximum pressure applied at a main end and where FG is the surface weight (in g/m$^2$) of the web entering the nip.

According to another aspect of the invention, a main beginning pressure $p_1$ is determined according to the relation $$\frac{p_1}{(bar)} \approx \left(\frac{T}{\%}\right)^{3.5\text{ to }4}$$

where T is the dry matter content of the web entering the nip. Further, the press section may include a rotating, flexible press belt, which is guided via at least one press shoe, and a counter roll, where the elongated nip is positioned between the rotating, flexible press belt and the counter roll. Additionally, the counter may include holes and/or grooves, and a suction device may be associated with the counter roll. Moreover, a region between the press shoe and the flexible press belt that is lubricated with water. Further, the rotating, flexible belt further comprising two ends faces, and where in the belt is open at its end faces.

According to another aspect of the invention, where the where the dry content of the web entering the nip is determined to be low, a pressure p is exerted in the inlet zone and/or the main zone, and the maximum pressure gradient is selected according to the relation $$\left(\frac{dp}{dl}\right)_{\max} \le 2\frac{bar}{\mathrm{cm}} \cdot \left(\frac{p}{bar}\right)^{1.27} \cdot \left(\frac{50\,\mathrm{g/m^2}}{FG}\right)$$

where FG is the surface weight (in g/m$^2$) of the web as it enters the nip. Further, this press section may also include a rotating, flexible press belt, which is guided via at least one press shoe, and a counter roll, wherein the elongated nip is positioned between the rotating, flexible press belt and the counter roll. the counter roll may include holes and/or grooves, and a suction device may be associated with the counter roll. A region between the press shoe and the flexible press belt may be lubricated with water. Moreover, the rotating, flexible belt may include two ends faces, where the rotating belt is open at its end faces.

Further, the aforementioned and following characteristic features of the present invention can be used not only in the described combinations, but also in other combinations or alone, without departing from the scope of the invention. Further embodiments and advantages can be seen from the detailed description and the accompanying Figures.

BRIEF DESCRIPTION OF THE DRAWINGS

The present invention is further described in the detailed description which follows, in reference to the noted drawings by way of non-limiting examples of preferred embodiments of the present invention, in which the reference numerals represent similar parts throughout the several views of the drawings, and wherein.

DETAILED DESCRIPTION OF THE INVENTION

Figure 1:
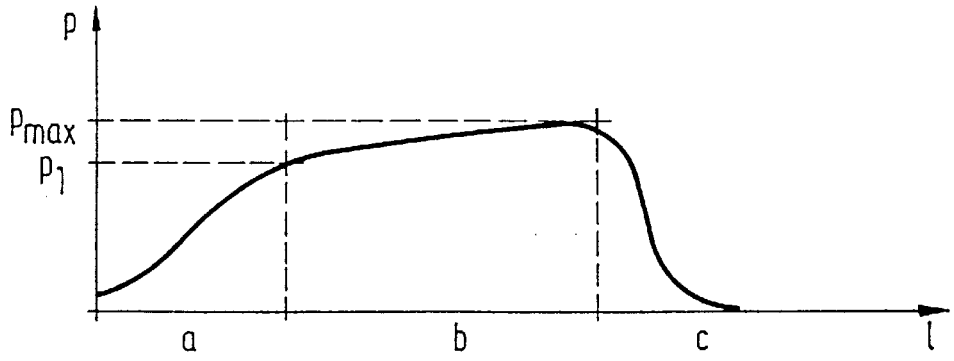
FIG. 1 is a schematic representation of the pressure profile in a nip that is elongated in the direction of web travel, which illustrates the elongated nip being divided into an inlet zone, a main pressing zone, and an outlet zone.

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing making apparent to those skilled in the art how the several forms of the invention may be embodied in practice.

FIG. 1 depicts a graphical representation of a profile of pressure p over a length l of the nip. According to FIG. 1, the elongated nip includes an inlet zone a, a main pressing zone b, and an outlet zone c, and the pressure profile in each zone is graphically represented with profile section a, profile section b and profile section c. While the pressure p continuously increases in inlet zone a (profile section a) and in main pressing zone b (profile section b), it drops in outlet zone c (profile section c).

A predeterminable pressure to be applied at the beginning of main pressing zone b is indicated as $p_l$. At substantially the end of the main pressing zone b, a predeterminable maximum pressure $p_{max}$ is applied.

The pressure gradient dp/dl of pressure p occurring in the main zone b of the nip (where the pressure gradient is produced in direction of web travel and therefore in the direction of length l) lies, according to the invention, in a range of approximately $0.01 \cdot p_{max}$/cm to approximately $0.08 \cdot p_{max}$/cm for a fibrous material web having an average to high dry matter content when entering the nip, and it preferably has a value of approximately $0.04 \cdot p_{max}$/cm.

In contrast, for a fibrous web having low dry matter content when it enters the nip, the maximum pressure gradient $(dp/dl)_{max}$ of pressure p produced in the inlet zone a and/or main processing zone b of the nip (where the pressure gradient occurs in the web travel direction) is selected so that it satisfies the relation:

$$\left(\frac{dp}{dl}\right)_{\max} \leq 2\frac{bar}{\text{cm}} \cdot \left(\frac{p}{bar}\right)^{1.27} \cdot \left(\frac{50\,\text{g/m}^2}{FG}\right)$$

where p once again is the pressure in the main pressing zone b, and FG is the surface weight (in $g/m^2$) of the incoming fibrous web. According to the present invention, the dry matter content of the fibrous material web is considered low when it is approximately 8% to approximately 25%.

The pressure gradient dp/dl of the pressure p produced in inlet zone a of the nip, for an incoming fibrous web of average to high dry matter content (where the pressure gradient is produced in the direction of web travel) is selected so that it satisfies the relation:

$$\frac{dp}{dl} \approx \left(\frac{100\,\text{g/m}^2}{FG}\right) \cdot \sqrt[4]{\frac{p_1}{bar}} \cdot \frac{p_1}{\text{cm}}$$

where $p_1$ is the predeterminable pressure at the beginning of main pressing zone b, or the predeterminable pressure at the end of inlet zone a, and FG is the surface weight (in $g/m^2$) of the incoming fibrous material web.

For an incoming fibrous web having average to high dry matter content, the pressure gradient dp/dl of the decreasing pressure p in outlet zone c of the nip (where, again, the pressure gradient occurs in the direction of web travel) is selected so that it essentially satisfies the relation:

$$\left|\frac{dp}{dl}\right| < \left(\frac{100\,\text{g/m}^2}{FG}\right) \cdot \sqrt[4]{\frac{p_{\max}}{bar}} \cdot \frac{p_{\max}}{\text{cm}}$$

where $p_{max}$ represents the predeterminable maximum pressure at the end of the main pressing zone b, and FG is the surface weight of the incoming fibrous web. Furthermore, the predeterminable pressure $p_1$ at the beginning of main pressing zone b is preferably selected so that is satisfies the relation:

$$\frac{p_1}{(bar)} \approx \left(\frac{T}{\%}\right)^{3.5\text{ to }4}$$

where T is the dry matter content of the incoming fibrous material web.

Figure 2:
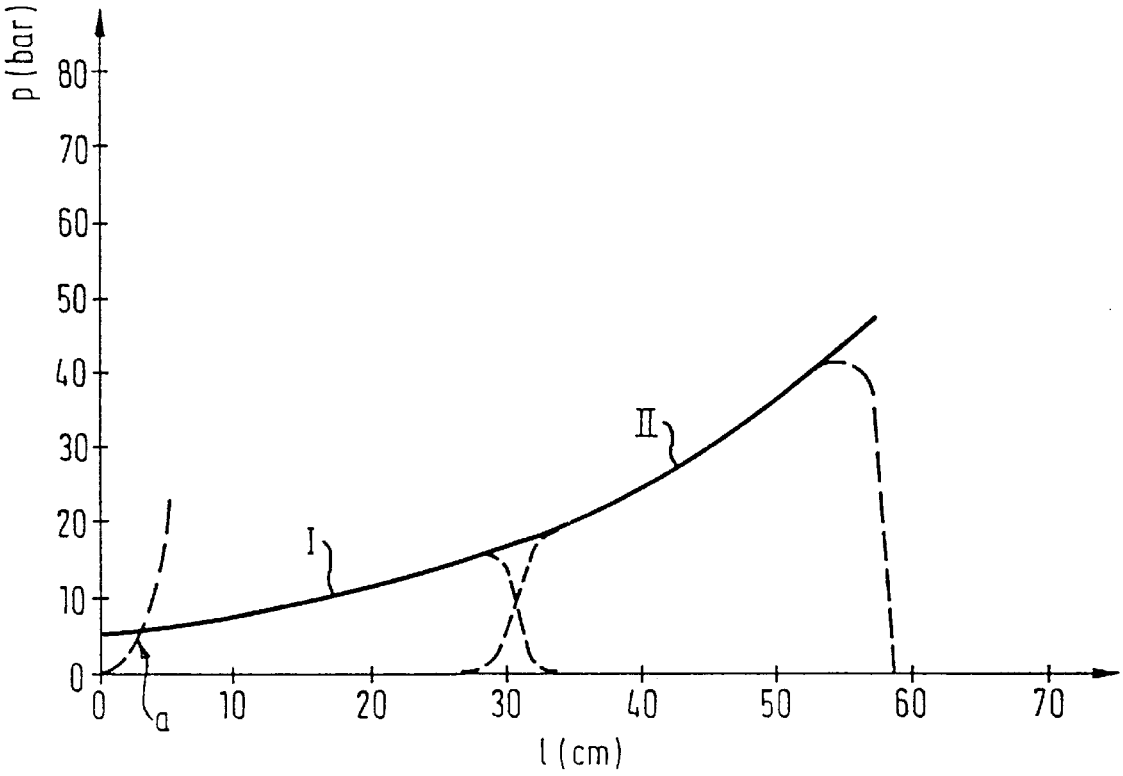
FIG. 2 is a diagram in which the pressure profile over two successive press sections is shown in schematic form.

FIG. 2 shows, a rough approximation of the increase in the pressure profile where at least two press shoes I, II are successively positioned one after the other in the direction of web travel. The first press show (press shoe I) is designed for treating a fibrous web having an average or high incoming dry matter content, in the range of, for example, approximately 25% to approximately 30%. In turn, press shoe II is designed to increase the dry matter content from approximately 35% to approximately 50%. The pressure gradient dp/dl of pressure p occurring in main pressing zone b of the nip (see also FIG. 1) in this example has a value of approximately $0.04 \cdot p_{max}$/cm. In FIG. 2, the increase in the pressure profile in inlet region a also is indicated in a purely graphical form (see also FIG. 1).

Figure 3:
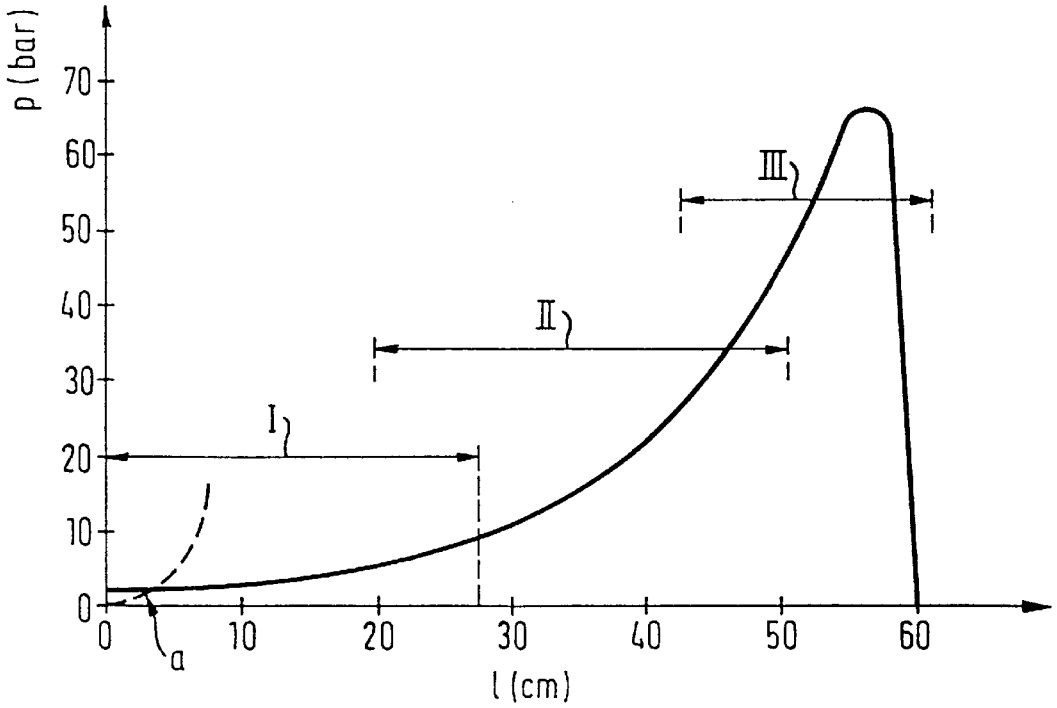
FIG. 3 is a diagram in which the pressure profile over three successive press sections is shown in schematic form.

FIG. 3 shows a rough approximation of the increase of the pressure profile where three press shoes I, II, III are successively positioned one after the other in the direction of web travel, and where the first press shoe I is designed for treating a fibrous web with a low dry matter content of, for example, less than about 20%. In turn, press shoe II is designed to increase the dry matter content from approximately 32% to approximately 40%, and press shoe III is designed to increase the dry matter content from approximately 40% to approximately 52%. The pressure gradient dp/dl of the pressure p produced in main pressing zone b of the nip (see also FIG. 1) is not permitted to exceed the previously indicated maximum pressure gradient $(dp/dl)_{max}$ which has been selected as a function of pressure $p_{max}$ at the end of the main pressing zone, and the surface weight (in $g/m^2$) of the incoming fibrous material web. In this example, the value of the pressure gradient dp/dl is $0.08 \cdot p_{max}$/cm where $p_{max}$ once again indicates the predeterminable pressure at the end of main pressing zone b. In the Figure, the increase in the pressure profile in inlet region a once again is indicated in a purely schematic form.

FIGS. 2 and 3 indicate the length l of the nip (in cm) plotted on the abscissa and the pressure p (in bar) plotted on the ordinate. In particular, the respectively desirable increase in pressure can be predetermined based on a corresponding shoe parameter (e.g., its length, shape, etc.).

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular materials and embodiments, the invention is not intended to be limited to the particulars disclosed herein; rather, the invention extends to a functionally equivalent structures, methods and uses, such as are within the scope of the appended claims.

What is claimed is:

1. A process for operating a press section for producing a fibrous web, comprising:

forming a nip that is elongated in a web travel direction, the nip including an inlet zone having an inlet beginning and an inlet end, a main pressing zone having a main beginning and a main end, and an outlet zone;

determining a pressure to be applied in the main pressing zone;

selecting a pressure gradient in the main pressing zone as a function of a dry matter content of the fibrous web entering the elongated nip, wherein the pressure gradient is related to the selected pressure to be applied in the main pressing zone;

guiding the fibrous web in a web travel direction through the elongated nip;

setting the selected pressure gradient;

wherein the selecting of the pressure gradient, when the dry content of the web entering the nip is in an average condition or a high condition, comprises:

setting a maximum pressure to be applied at the main end of the nip; and producing the pressure gradient from a range of approximately $0.01 \cdot p_{max}$/cm to approximately $0.08 \cdot p_{max}$/cm, where $p_{max}$ represents the determined maximum pressure to be applied and is in the range of approximately 20 bar to 100 bar.

2. A process according to claim 1, wherein the selected pressure gradient has a value of approximately $0.04 \cdot p_{max}$/cm.

3. A process according to claim 1, comprising forming the nip by guiding a rotating, flexible press belt via a press shoe against a counter roll.

4. A process according to claim 3, further comprising suctioning the counter roll, wherein the counter roll comprises at least one of holes and grooves.

5. A process according to claim 3, further comprising lubricating a region between the press section and the flexible press belt with water.

6. A process according to claim 3, wherein the rotating, flexible belt comprises two ends faces, and wherein the belt is open at the end faces.

7. A process according to claim 1, wherein a dry matter content of the web as it enters the nip of approximately 20% to 40% constitutes the average conditions.

8. A process according to claim 1, wherein a dry matter content of the web as it enters the nip of approximately 30% to 60% constitutes the high condition.

9. A process for operating a press section for producing a fibrous web, comprising:

forming a nip that is elongated in a web travel direction, the nip including an inlet zone having an inlet beginning and an inlet end, a main pressing zone having a main beginning and a main end; and an outlet zone;

determining a pressure to be applied in the main pressing zone;

selecting a pressure gradient in the main pressing zone as a function of a dry matter content of the fibrous web entering the elongated nip, wherein the pressure gradient is related to the selected pressure to be applied in the main pressing zone;

guiding the fibrous web in a web travel direction through the elongated nip; and setting the selected pressure gradient; and setting a main beginning pressure ($p_1$) in accordance with the relation $$\frac{p_1}{(bar)} \approx \left(\frac{T}{\%}\right)^{3.5\text{ to }4}$$

where T is the dry matter content of the web entering the nip.

10. A process for operating a press section for producing a fibrous web, comprising:

forming a nip that is elongated in a web travel direction, the nip including an inlet zone having an inlet beginning and an inlet end, a main pressing zone having a main beginning and a main end, and an outlet zone;

setting a pressure to be applied in the main pressing zone;

producing a pressure gradient in the main pressing zone as a function of a dry matter content of the fibrous web entering the elongated nip, wherein the pressure gradient is related to the selected pressure to be applied in the main pressing zone;

guiding the fibrous web in a web travel direction through the elongated nip; and setting the selected pressure gradient;

wherein the selecting of he pressure gradient, when the dry content of the web entering the nip is in a low condition, comprises selecting a maximum main zone pressure gradient according to the relation $$\left(\frac{dp}{dl}\right)_{\max} \leq 2\frac{bar}{\text{cm}} \cdot \left(\frac{p}{bar}\right)^{1.27} \cdot \left(\frac{50\,\text{g/m}^2}{FG}\right)$$

where FG is a surface weight (in g/m$^2$) of the web entering the nip.

11. A process according to claim 10, comprising forming the nip by guiding a rotating, flexible press belt via a press shoe against a counter roll.

12. A process according to claim 11, further comprising suctioning the counter roll, wherein the counter roll comprises at least one of holes and grooves.

13. A process according to claim 11, further comprising lubricating a region between the press section and the flexible press belt with water.

14. A process according to claim 11, wherein the rotating, flexible belt comprises two ends faces, and wherein the belt is open at the end faces.

15. A process according to claim 10, wherein a dry matter content of the web as it enters the nip of approximately 8% to 25% constitutes the low condition.

16. A process for operating a press section for producing a fibrous web, comprising:

forming a nip that is elongated in a web travel direction, the nip including an inlet zone having an inlet beginning and an inlet end, a main pressing zone having a main beginning and a main end, and an outlet zone;

determining a pressure to be applied in the main pressing zone;

selecting a pressure gradient in the main pressing zone as a function of a dry matter content of the fibrous web entering the elongated nip, wherein the pressure gradient is related to the selected pressure to be applied in the main pressing zone;

guiding the fibrous web in a web travel direction through the elongated nip; and setting the selected pressure gradient;

wherein the selecting of the pressure gradient, when the dry content of the web entering the nip is in a low condition, comprises selecting a maximum main zone pressure gradient according to the relation $$\left(\frac{dp}{dl}\right)_{\max} \leq 2\frac{bar}{\text{cm}} \cdot \left(\frac{p}{bar}\right)^{1.27} \cdot \left(\frac{50\,\text{g/m}^2}{FG}\right)$$

where FG is a surface weight (in g/m$^2$) of the web entering the nip.

17. A process according to claim 16, comprising forming the nip by guiding a rotating, flexible press belt via a press shoe against a counter roll.

18. A process according to claim 17, further comprising suctioning the counter roll, wherein the counter roll comprises at least one of holes and grooves.

19. A process according to claim 1, further comprising lubricating a region between the press section and the flexible press belt with water.

20. A process according to claim 1, wherein the rotating, flexible belt comprises two ends faces, and wherein the belt is open at the end faces.

21. A process according to claim 16, wherein a dry matter content of the web as it enters the nip of approximately 8% to 25% constitutes the low condition.

22. A process for operating a press section for producing a fibrous web, comprising:

forming a nip that is elongated in a web travel direction, the nip including an inlet zone having an inlet beginning and an inlet end, a main pressing zone having a main beginning and a main end, and an outlet zone;

determining a pressure to be applied in the main pressing zone;

selecting a pressure gradient in the main pressing zone as a function of a dry matter content of the fibrous web entering the elongated nip, wherein the pressure gradient is related to the selected pressure to be applied in the main pressing zone;

guiding the fibrous web in a web travel direction through the elongated nip;

setting the selected pressure gradient; and producing an inlet pressure gradient in the inlet zone according to the relation $$\frac{dp}{dl} \approx \left(\frac{100\,\mathrm{g/m^2}}{FG}\right) \cdot \sqrt[4]{\frac{p_1}{bar}} \cdot \frac{p_1}{\mathrm{cm}}$$

where $p_1$ is a pressure to be exerted at one of the main beginning and the inlet end, and where FG is a surface weight (in $g/m^2$) of the web entering the nip.

23. A process for operating a press section for producing a fibrous web, comprising:

forming a nip that is elongated in a web travel direction, the nip including an inlet zone having an inlet beginning and an inlet end, a main pressing zone having a main beginning and a main end, and an outlet zone;

setting a pressure to be applied in the main pressing zone;

producing a pressure gradient in the main pressing zone as a function of a dry matter content of the fibrous web entering the elongated nip, wherein the pressure gradient is related to the selected pressure to be applied in the main pressing zone;

guiding the fibrous web in a web travel direction through the elongated nip;

setting the selected pressure gradient; and producing an outlet pressure gradient in the outlet zone according to the relation $$\left|\frac{dp}{dl}\right| < \left(\frac{100\,\mathrm{g/m^2}}{FG}\right) \cdot \sqrt[4]{\frac{p_{\max}}{bar}} \cdot \frac{p_{\max}}{\mathrm{cm}}$$

where $p_{max}$ is a maximum pressure to be applied at the main end, and where FG is a surface weight (in $g/m^2$) of the web entering the nip.

* * * * *